US005149175A

United States Patent [19]

Hills

[11] Patent Number: 5,149,175

[45] Date of Patent: Sep. 22, 1992

[54] THIN SEAM MINING AND RELATED SORTING METHOD

[75] Inventor: Robert C. Hills, Kingsport, Tenn.

[73] Assignee: Amvest Corporation, Charlottesville, Va.

[21] Appl. No.: 684,868

[22] Filed: Apr. 15, 1991

[51] Int. Cl.[5] ..... F21C 35/20; B07C 5/346

[52] U.S. Cl. ..... 299/1.9; 299/18; 209/589

[58] Field of Search ..... 299/1.1, 1.9, 18, 7, 299/8; 209/576, 577, 589, 655

[56] References Cited

U.S. PATENT DOCUMENTS

| | | | |
|---|---|---|---|
| 3,237,765 | 3/1966 | Gaudin et al. | 209/655 X |
| 3,834,761 | 9/1974 | Ray et al. | 299/10 |
| 4,174,135 | 11/1979 | Grenia | 299/11 |
| 4,953,915 | 9/1990 | Jasser | 299/18 |

FOREIGN PATENT DOCUMENTS

| | | | |
|---|---|---|---|
| 547836 | 11/1957 | Canada | 209/598 |
| 757192 | 8/1980 | U.S.S.R. | 209/589 |
| 939086 | 6/1982 | U.S.S.R. | 209/589 |
| 988377 | 1/1983 | U.S.S.R. | 209/589 |
| 1050741 | 10/1983 | U.S.S.R. | 209/589 |
| 1346566 | 2/1974 | United Kingdom | 209/589 |

*Primary Examiner*—David J. Bagnell
*Attorney, Agent, or Firm*—Nixon & Vanderhye

[57] ABSTRACT

A method of split load mining a coal seam having a thickness less than that conventionally considered economical to mine is economically mined utilizing a cutting head having a diameter equal to the coal seam thickness. Coal in the coal seam is cut and conveyed from the mine bore to the mine mouth, and periodically the overburden is out to enlarge the bore, thereby generating non-coal (e.g. rock) cut material. The cut coal and rock are continously automatically conveyed in a common path in separate masses away from the bore mouth while the ash content or the material is automatically analyzed to determine whether conveyed material at a first location is primarily coal (e.g. less than about 50-60% ash) or primarily rock. In response to the automatic analyzing, the material is automatically diverted to a second location if coal, and to a third location if rock. An angled conveyor belt is utilized to convey the coal and rock for analysis and sorting, and the analyzer preferably is a radioisotope gauge. A diverter at the end of the conveyor belt is preferably an inverted Y-shaped conduit with a diverter vane within it. A vertical barrier below the conduit stem defines the second and third locations.

10 Claims, 2 Drawing Sheets

COM-
PUTER
INPUT
OUTPUT
COAL
ROCK
MINER, CONVEYOR

THIN SEAM MINING AND RELATED SORTING METHOD

BACKGROUND AND SUMMARY OF THE INVENTION

There are many coal seams throughout the world that are conventionally (presently) considered uneconomical to mine because of the thinness of the seam. However, according to the method of the present invention, in utilizing apparatus according to the present invention, it is possible to economically mine such seams utilizing split loading mining techniques. According to the invention, it is possible to economically mine a thin coal seam for example, one having a thickness of between about one and four feet, e.g., about 2–33 feet) by cutting the coal, and then cutting into the overburden or the bore floor in order to enlarge the bore, since it is possible to automatically distinguish between masses of conveyed cut material and to readily separate the mined coal from the rock overburden or the like. This is preferably accomplished, according to the invention, by utilizing a conventional radioisotope gauge that is normally employed to distinguish between ash contents of different coals.

According to one aspect of the present invention, a method of split load mining a coal seam having a thickness (e.g., between about 1–4 feet) less than that conventionally considered economical to mine, utilizing a cutting element having an operative cutting dimension approximately equal to the coal seam thickness, is provided. The method comprises the following steps:

(a) Cutting into essentially only the coal seam with the cutting element to form a mine bore having a mouth.

(b) Conveying cut coal from the bore to the mouth.

(c) Periodically interrupting steps (a) and (b) to cut into overburden or the bore floor to enlarge the bore to provide adequate clearance distance for the mining operation, thereby generating non-coal cut material.

(d) Conveying the non-coal cut material from the bore to the mouth.

(e) Substantially continuously automatically conveying the cut coal and non-coal cut material in a common path away from the bore mouth.

(f) While practicing step (e), substantially continuously automatically analyzing at least one property of the conveyed material that distinguishes coal from non-coal, to determine whether conveyed material at a first location along the common path is primarily coal or primarily non-coal; and (g) In response to step (f), automatically diverting primarily coal to a second location, and diverting primarily non-coal to a third location.

In the practice of the method described above, step (f) is preferably practiced by analyzing the ash content of the material and utilizing a conventional radioisotope gauge. Step (e) is preferably practiced by providing a common conveyance path extending upwardly from the bore mouth at an angle greater than about 1 degree and less than about 17 degrees (e.g. about 10°), and utilizing a conveyor belt. Step (c) is preferably practiced by cutting into rock overburden with a cutting drum, and step (d) is practiced by conveying cut rock. Step (g) is preferably practiced by moving a diverting vane to and from a first position which diverts conveyed material from the end of the conveyor belt to the second location on the first side of a vertical barrier, and a second position which diverts conveyed material from the end of the conveyor belt to the third location on the second side of the vertical barrier.

According to another aspect of the present invention, apparatus for mining coal and separating mined coal from non-coal (e.g., rock overburden) material transported from the same mine as the coal, is provided. The apparatus according to the invention comprises:

A conveyor for automatically substantially continuously conveying both coal and non-coal material from the mine in a common conveyance path.

Means for continuously automatically analyzing at least one property of the conveyed material on the conveyor that distinguishes coal from non-coal, to determine whether conveyed material at a first location along the conveyance path is primarily coal or primarily non-coal.

Diverting means at the end of the conveyor conveyance path remote from the mine; and Means responsive to the automatically analyzing means for controlling the diverting means to automatically divert primarily coal to a second location, and to automatically divert primarily non-coal to a third location.

Preferably in the apparatus described above the conveyor comprises a conveyor belt which is disposed extending upwardly from the mine at an angle between about 0 and 20 degrees, and the automatic analyzing means comprises a radioisotope gauge for analyzing the ash content of the material. The diverting means preferably comprises an inverted Y-shaped conduit section having first and second hollow legs extending from a hollow stem at the top end of the conveyor belt, and a diverter vane within the conduit section mounted for rotation about a substantially horizontal axis by a shaft. The diverter vane is movable between a first position in which it blocks off the first hollow leg from the stem, and a second position in which it blocks off the second hollow leg from the stem. The diverter means also preferably comprises a vertical barrier disposed below the diverter stem and defining the second location on one side thereof and the third location on an opposite side thereof. The control means preferably comprises a motor or linear actuator operatively connected to the shaft for effecting rotation of the shaft about the substantially horizontal axis, and a computer operatively connected to the motor or linear actuator and radioisotope gauge.

It is the primary object of the invention to provide an effective method for economically mining coal seams having a thickness less than that conventionally considered economical to mine, and to provide simple yet effective apparatus for facilitating that method. This and other objects of the invention will become clear from an inspection of the detailed description of the invention and from the invented claims.

DETAILED DESCRIPTION OF THE DRAWINGS

Figures 1, 2:
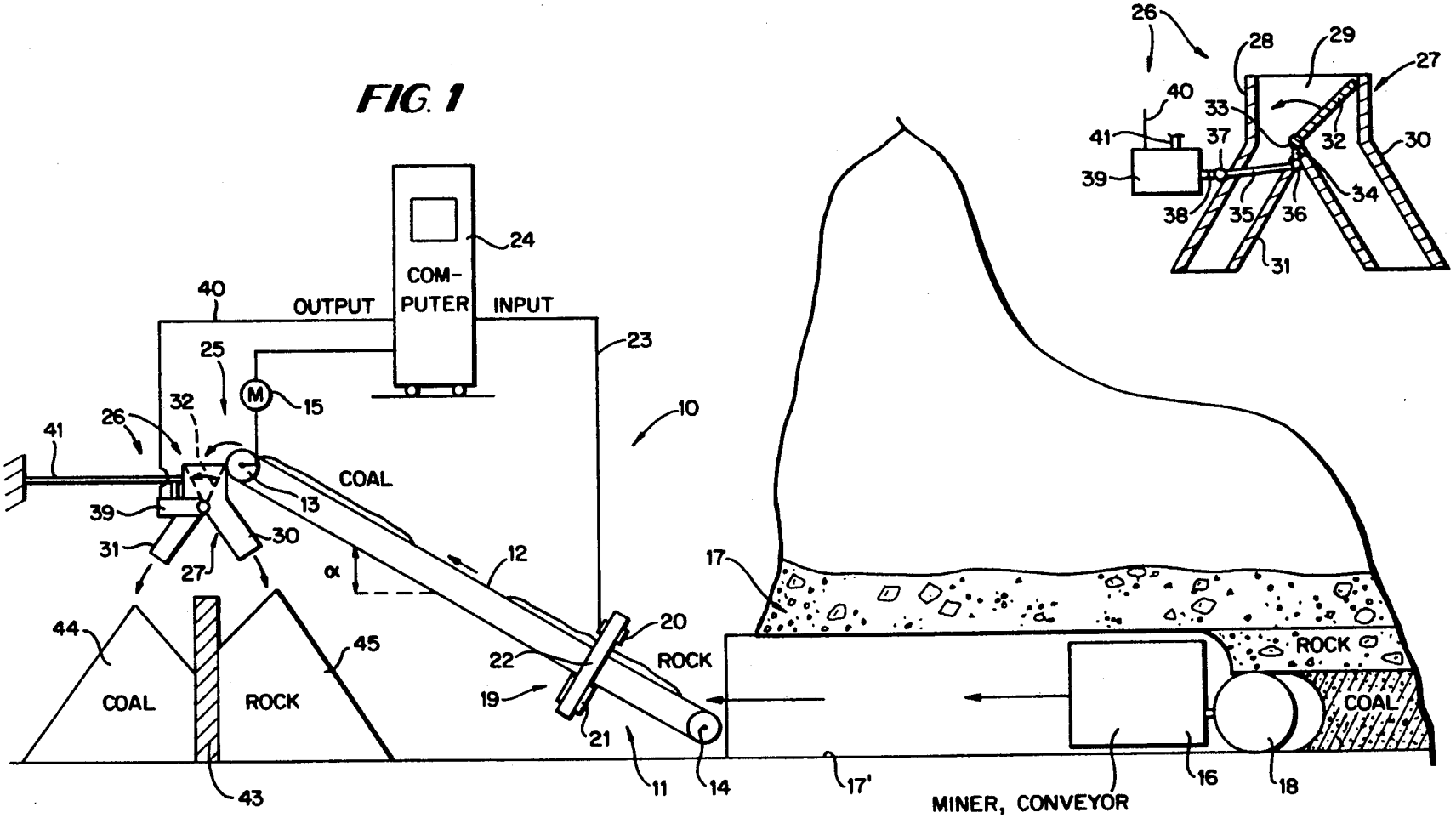
FIG. 1 is a side schematic view showing exemplary apparatus for practice of an exemplary method according to the present invention.
FIG. 2 is a detail vertical sectional view of along the diverter of FIG. 1.

An apparatus 10 for facilitating a method of split load mining of a coal seam having a thickness (e.g., between about one and four feet, more particularly about 2–3 feet) less than that conventionally considered economical to mine, is provided according to the invention The term "coal" as used in the present application is intended to encompass all types of solid hydrocarbon fuel or resource materials, such as bituminous, anthracite, lignite, peat, and the like.

The apparatus 10 effecting conveyance of cut material from a mine and separation of the material into coal and non-coal components. The apparatus 10 includes a conveyor means 11, preferably a conventional conveyor belt 12 disposed at an angle $\alpha$ with respect to the mine mouth (which angle $\alpha$ is preferably between about 0 and 20 degrees, e.g. about 1°–17°, or about 10°, although it could be negative if the mine mouth is elevated), and having conventional rollers 13, 14 mounted at the opposite ends thereof. Of course, any number of intermediate supporting or drive rollers may also be provided. At least one of the rollers, preferably roller 13, is driven by a conventional motor 15. The conveyor 11 is disposed adjacent the mouth 17 of a mine, in which a conventional miner 16 (which may have a conveyor associated therewith) having a cutting element 18 associated therewith is disposed.

The miner 16 performs a mining technique that is generally known as split loading. The miner 16 is a conventional continuous miner, the particular brand not being important. The miner cutting element 18 preferably is a conventional cutting drum that has an effective diameter that is substantially the same as the thickness of the coal seam (see FIG. 1) being mined.

In typical operation of the miner 16, the cutting drum 18 is continuously rotated and sumped into the coal seam minimizing any out of seam dilution, and forming a bore 17'. The cut coal is conveyed rearwardly from the continuous miner 16 to the mine mouth 17 utilizing any conventional conveying means, which may include shuttle cars, conveyor belts, augers, or the like. Because the thickness of the coal seam is not sufficient to provide adequate clearance for mining (e.g., adequate clearance for the conventional continuous miner 16, shuttle cars, roof bolting machines, or the like) it is necessary to periodically interrupt the cutting of the coal seam and instead move the mining head 18 either into the overburden or into the floor of the bore 17' to cut non-coal material to provide adequate clearance. The cut non-coal material—typically rock overburden (as illustrated schematically in FIG. 1) is also conveyed by the continuous miner conventional conveying apparatus to the mine mouth 17. Since the coal seam cutting and overburden cutting steps are performed sequentially (at different times), there will be little mixing of overburden and coal, but rather the overburden and coal will be conveyed in separate, spaced masses to the conveyor 11, as shown schematically in FIG. 1.

Associated with the conveyor 11 is the automatic analyzing means 19. The automatic analyzing means 19 analyzes the conveyed material (on the conveyor belt 12) and is capable of determining at least one property of the conveyed material that is distinct between the typically conveyed materials (that is, a property of the coal that is distinct from that of rock). Preferably the property that the analyzing means 19 determines is ash content. An entirely suitable apparatus for determining ash content (which is typically used to determine different ash percentages of different types of coal) is a product sold by Science Applications International Corporation of Oak Ridge, Tenn. under the designation "Model 400 Ashmeter."

The conventional "Model 400 Ashmeter" includes a radioactive source assembly 20 mounted above the conveyor belt 12, and a detector assembly 21, the assemblies 20, 21 interconnected by supporting structure 22 and operatively connected by cabling 23 to a computer 24 having software capable of analyzing ash content from the information supplied by the detector assembly 21. The computer 24 may also be used to control the motor 15, or to receive information about whether or not the motor is running, and the speed of the motor 15 as well as the distance between the analyzer 19 and the top end 25 (at roller 13) of the conveyor 11 are preferably fed into the computer 24. The computer 24 preferably is calibrated so that if the ash content is less than about fifty-sixty percent (50–60%) it recognizes the material to be coal, whereas if the ash content is greater than about fifty-sixty percent it recognizes it to be non-coal (e.g., rock). At the top end 25 of the conveyor 11 is a diverting means 26.

The diverting means 26 is shown most clearly in FIG. 2, and comprises an inverted Y-shaped conduit section 27, which has a length substantially the same as the operative width of the conveyor belt 12. The conduit section 27 includes a stem 28 open at the top 29 thereof to receive conveyed material from the belt 12, and a pair of hollow legs 30, 31. Mounted within the stem 28 is a relatively rigid diverter vane 32, having substantially the same length as the interior length of the stem 28, and mounted for rotation about a generally horizontal axis by a shaft 33. The diverter vane is moved between the two dotted line positions illustrated in FIG. 1.

The structure for moving the diverter vane 32 comprises the arm 34 rigidly connected to the shaft 33 and exterior of the conduit section 27. The arm 34 is preferably connected by a link 35—pivoted at the ends 36, 37 thereof—to a rod 38 of a linear actuator 39 (e.g., a solenoid, hydraulic or pneumatic cylinder, or the like), or an electric motor connected to a gear reducer. Control of the linear actuator or motor 39 is provided by the cabling 40, also connected to the computer 24. The conduit section 27—and the actuator/motor 39—are preferably stationarily mounted at the end of the conveyor belt 12 by any suitable support, such as the beam 41 schematically illustrated in FIG. 1.

As a further part of the diverter means 26, a vertical barrier 43 (see FIG. 1) also is preferably provided, mounted below shaft 33. The barrier 43 defines a location 44 for coal on one side thereof, and a location 45 for rock (or other non-coal cut material) on the opposite side thereof. If necessary or desirable for a given mine, sorting to three, or even more, piles may be provided by positioning multiple barriers, and multiple positions of the diverter.

Figure 3:
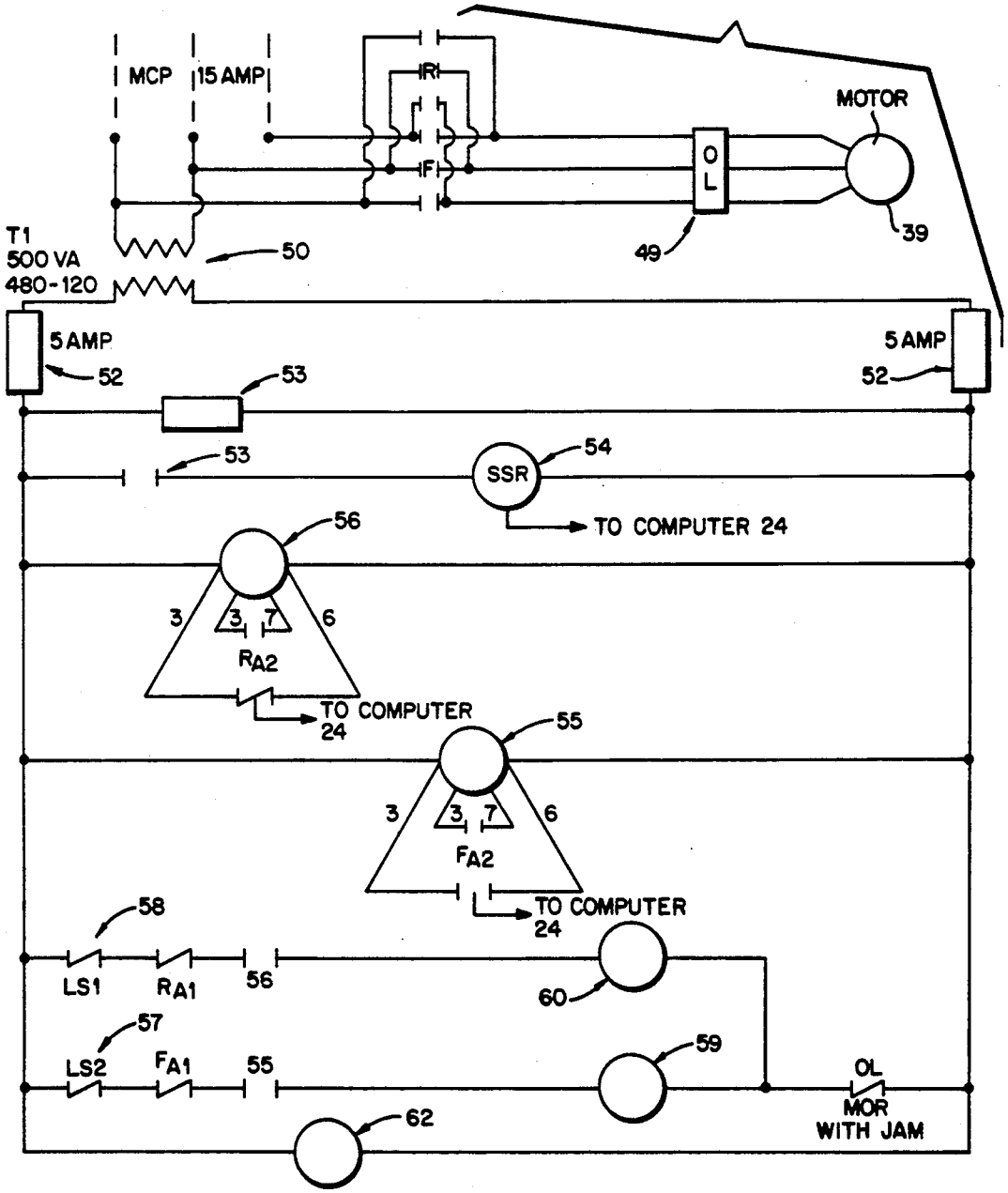
FIG. 3 is an electrical schematic showing an exemplary control for the diverter.

FIG. 3 is an electrical schematic showing the connection of a motor 39 to the computer 24 and other control components. The motor 39 is in operative association with an amperage overload sensor 49, and is connected by a transformer 50 or a like coupling to circuitry including fuses 52, mini-slips switches 53, a slip switch relay 54, timing relays 55, 56, limit switches 57, 58, operating coils (solenoids) 59, 60 associated with the limit switches 57, 58, and a modular overload relay 62.

The timing relays 55, 56 are not essential but are desirable in some environments.

Utilizing the apparatus heretofore described, a method of split load mining a coal seam having a thickness less than that conventionally considered economical to mine (e.g. about one-four feet) is provided. The method comprises the following steps:

—Cutting into the coal seam with the cutting element (cutting drum 18 having a diameter substantially equal to the thickness of the coal seam) of conventional continuous miner 16, to form a mine bore 17' having a mouth 17.

—Conveying cut coal from the bore to the mouth 17, e.g., utilizing conventional shuttle cars, augers, conveyor belts, or like conveyance means associated with conventional continuous miner 16.

—Periodically interrupting the coal cutting step to cut into the overburden rock (as illustrated in FIG. 1) or the bore 17' floor to enlarge the bore 17' to provide adequate vertical clearance distance for the mining operation, thereby generating non-coal cut material (e.g., rock).

—Conveying the non-coal cut material (rock) from the bore 17' to the mouth 17.

—Substantially continuously automatically conveying the cut coal and non-coal cut material in a common path away from the bore mouth 17. This is accomplished utilizing the conveyor belt 12 which conveys the mass of coal and the separate (typically spaced, since it was cut at a different time in the mining sequence) rock mass in a generally upward angled common conveyance path, away from the bore mouth 17, to the top end 25 (at roller 13) of the belt 12. The thickness of the mass of coal or rock being conveyed up the belt 12 preferably is between about 3–6 inches.

—While practicing the automatic conveyance step, substantially continuously automatically analyzing at least one property of the conveyed material that distinguishes coal from non-coal (e.g., the ash content), utilizing the analyzer 19, to determine whether the conveyed material at a first location 25 is primarily coal (e.g., less than about 50–60% ash) or primarily non-coal (e.g., greater than about 50–60% ash); and —In response to the analyzing step, automatically diverting primarily coal to a second location 44, and diverting primarily non-coal to a third location 45, using diverting means 26.

The automatic diverting step is practiced by utilizing the computer 24 to control the motor or linear actuator 39. In the first position of the motor or linear actuator 39 the vane 32 has been rotated by the shaft 33 to the position illustrated in FIG. 2, in which it blocks off the hollow leg 30, causing the conveyed material falling downwardly from the belt 12 into the open top 29 of the conduit section 27 to flow through diverter leg 31, and to the left side of the vertical barrier 43 as seen in FIG. 1. Once the analyzer 19 and computer 24 determine that non-coal (e.g., rock overburden) is at the first location 25, the motor or linear actuator 39 rotates the vane 32 about its axis so that it blocks off the leg 31, and allows the rock to fall only into the leg 30, from which it falls on the opposite side of the barrier 43 from the coal, in the third location 45. After separation utilizing diverter means 26 and the computer control 24 therefor, the coal (low ash pile) at the second location 44 is trucked or otherwise transported to a coal preparation plant, while the high ash material (rock or other non-coal) at the third location 45 is trucked or otherwise transported to a refuse hollow fill, or the like.

Since the method according to the invention is automatic, it utilizes commercially available or easily constructed, relatively simple, equipment, it may economically mine coal seams previously considered too thin to economically mine. Thus, the invention is advantageous.

While the invention has been herein shown and described in what is presently conceived to be the most practical and preferred embodiments thereof, it will be apparent to those of ordinary skill in the art that many modifications may be made thereof within the scope of the invention, which scope is to be accorded the broadest interpretation of the appended claims so as to encompass all equivalent methods and apparatus.

What is claimed is:

1. A method of split load mining a coal seam having a thickness less than that conventionally considered economical to mine utilizing a cutting element having an operative cutting dimension approximately equal to the coal seam thickness, comprising the steps of:

(a) cutting into essentially only the coal seam with the cutting element to form a mine bore having a mouth;

(b) conveying cut coal from the bore to the mouth;

(c) periodically interrupting steps (a) and (b) to cut into overburden or the bore floor to enlarge the bore to provide adequate clearance distance for the mining operation, thereby generating non-coal cut material;

(d) conveying the non-coal cut material from the bore to the mouth;

(e) substantially continuously automatically conveying the cut coal and non-coal cut material in a common path away from the bore mouth;

(f) while practicing step (e), substantially continuously automatically analyzing at least one property of the conveyed material that distinguishes coal from non-coal, to determine whether conveyed material at a first location along the common path is primarily coal or primarily non-coal; and (g) in response to step (f), automatically diverting primarily coal to a second location, and diverting primarily non-coal to a third location.

2. A method as recited in claim 1 wherein step (f) is practiced by analyzing the ash content of the material.

3. A method as recited in claim 2 wherein step (f) is further practiced using a radioisotope gauge.

4. A method as recited in claim 2 wherein step (e) is practiced by providing a common conveyance path extending upwardly from the bore mouth at an angle greater than about 1 degree and less than about 17 degrees.

5. A method as recited in claim 4 wherein step (e) is further practiced using a conveyor belt, and wherein step (c) is practiced by cutting into rock overburden, and step (d) is practiced by conveying cut rock.

6. A method as recited in claim 5 further utilizing a diverting vane and vertical barrier, and wherein step (g) is practiced by moving the diverting vane to and from a first position which diverts conveyed material from the end of the conveyor belt to the second location on a first side of the vertical barrier, and a second position which diverts conveyed material from the end of the conveyor belt to the third location on a second side of the vertical barrier.

7. A method as recited in claim 6 wherein step (a) is practiced in a coal seam having a thickness of between about one and four feet.

8. A method as recited in claim 2 wherein step (f) is practiced so that material having an ash content of less then about 50–60% is recognized as coal, and material with an ash content of greater than about 50–60% is recognized as non-coal.

9. A method as recited in claim 1 wherein step (a) is practiced in a coal seam having a thickness of between about two and three feet.

10. A method as recited in claim 1 wherein step (c) is practiced by cutting into rock overburden, and step (d) is practiced by conveying cut rock.

* * * * *